US005277132A

United States Patent [19]

Korb

[11] Patent Number: 5,277,132

[45] Date of Patent: Jan. 11, 1994

[54] OFFICE FURNITURE PIECE COMBINATION

[75] Inventor: Daniel Korb, Sindelfingen, Fed. Rep. of Germany

[73] Assignee: Dyes GmbH Buromobelfabrik, Fed. Rep. of Germany

[21] Appl. No.: 756,228

[22] Filed: Sep. 6, 1991

[30] Foreign Application Priority Data

Sep. 7, 1990 [DE] Fed. Rep. of Germany ..... 4028453

[51] Int. Cl.[5] ..... A47B 57/00

[52] U.S. Cl. ..... 108/64; 108/65

[58] Field of Search ..... 108/64, 65, 69, 134, 108/135, 50; 403/362, 367, 373

[56] References Cited

U.S. PATENT DOCUMENTS

| | | | |
|---|---|---|---|
| 2,031,398 | 2/1936 | Wagoner | 108/64 |
| 2,048,289 | 8/1958 | Page | 108/64 X |
| 3,695,189 | 10/1972 | Felder, Jr. | 108/65 |
| 4,409,906 | 10/1983 | Alneng | 108/64 X |
| 4,570,402 | 2/1986 | Johnson | 108/64 X |
| 4,591,289 | 5/1986 | Vickers et al. | 108/64 X |
| 4,679,510 | 7/1987 | Veyhl et al. | 108/64 X |
| 4,740,033 | 4/1988 | Lee | 108/64 X |
| 4,748,913 | 6/1988 | Favaretto et al. | 108/64 X |
| 5,144,888 | 9/1992 | Heine et al. | 108/64 |

*Primary Examiner*—Jose V. Chen

*Attorney, Agent, or Firm*—Speckman, Pauley & Fejer

[57] ABSTRACT

An office furniture piece combination of a plurality of pieces of office furniture, in particular office desks. A frame with a uniform cross piece has lateral legs which can be connected with each other by a non-free-standing coupling elements using bolts and receivers. A simple, rigid connection between the cross pieces of adjacent office furniture pieces and the coupling element, which can be made and released without tools, is achieved with receivers positioned into the front faces of the cross pieces. The exterior cross section of the coupling elements are essentially adapted to the exterior cross section of the cross pieces and support rotatably seated locking bolts which are oriented towards the receivers of the cross pieces. The coupling elements have a preset, identical dimension in the longitudinal direction of the cross pieces. The locking bolts extend from both front faces of the coupling elements with eccentric locking heads or clamping bolts. With the rotation of the locking bolts, the locking heads or clamping bolts inserted into the receivers of the cross pieces are automatically clamped therein or grip the receivers in the cross pieces from behind and clamp the cross pieces to the coupling element and to each other.

20 Claims, 7 Drawing Sheets

OFFICE FURNITURE PIECE COMBINATION

BACKGROUND OF THE INVENTION

1. Field of the Invention

This invention relates to an office furniture piece combination of a plurality of pieces of office furniture, particularly office desks having a frame constructed of a uniform cross piece with lateral legs which can be connected to each other by non-free-standing coupling elements having bolts and receivers. Exterior cross sections of the coupling elements are adapted to the exterior cross sections of the cross pieces and have a preset, identical dimension in the longitudinal direction of the cross pieces. The bolts can also be constructed as undercut, protruding clamping bolts.

2. Description of Prior Art

Combinations of office furniture pieces are known from German Utility Model DE-GM 75 17 546 and British patent publication GB 20 25 211. It is generally known that a simple plug connection, which is secured by screws, splints or the like, or a snap-in connection with snap-in bolts and snap-in receivers is used with these known combinations of office furniture pieces. However, these connections can neither be constructed in a simple manner nor are they sufficiently stable.

A coupling element is known from German Utility Model DE-GM 82 29 796, which is constructed as a Z-shaped angle piece, and is fastened flat with one leg on an underside of a cross piece and supports the add-on office furniture piece, for example a connecting plate, with a leg projecting away from the cross piece. In this case, the leg of the angle piece supporting the connecting plate has upwardly extending bolts which are inserted into corresponding blind bores on the underside of the connecting plate. These Z-shaped angle pieces are not suitable as coupling elements for creating a rigid connection even between two similar office desks, since it is always possible to release the connection inadvertently by displacing the add-on pieces in a vertical direction.

As shown by German Utility Model DE-GM 77 39 584, it is also known to connect add-on pieces with horizontal plug connections made of pins and holes. This connection is inadequate for a combination of office furniture pieces, because the plug connections are only maintained by frictional force and a non-releasable connection is not desired in order to make it possible to change the combination of office furniture pieces at any time.

SUMMARY OF THE INVENTION

It is an object of this invention to provide a coupling element for a combination of office furniture pieces in which it is easily and quickly possible to provide a rigid, but simply releasable connection between adjoining furniture pieces.

According to one preferred embodiment of this invention, the above object is achieved by placing the receivers into front faces of the cross pieces. The receivers of the cross pieces support bolts in the form of rotatably seated locking bolts. The locking bolts extend from both front faces of the coupling elements with eccentric locking heads or with protruding clamping bolts. By turning the locking bolts, the locking heads or locking bolts inserted into the receivers of the cross pieces are automatically clamped therein or grip the receivers in the cross pieces from behind and thus clamp the cross pieces to the coupling element and to each other. On the other hand, the clamping bolts can be fastened on the front sides of the cross pieces or they can be fastened there. The receivers on the front faces of the coupling elements are constructed as vertical keyhole receivers and are positioned on the two front faces of the coupling elements, rotated by 180° and lined up in pairs relative to each other. The coupling elements have a preset, identical dimension in the direction of the cross pieces and are essentially adapted with their exterior cross section to the exterior cross section of the cross pieces. A common clamping block is associated with each pair of keyhole receivers in the coupling element, which is displaceable crosswise to the longitudinal direction of the cross pieces. In a clamped position, the clamping block at least partially grips the associated clamping bolts of the cross pieces which are to be connected with each other from behind and fixes them in the associated keyhole receivers, in a non-displaceable manner.

In every case the coupling element forms a separate unit, which can be directly connected with the receivers of clamping bolts on the front faces of the cross pieces, thereby resulting in a secure connection. With the locking bolts, it is possible to achieve crosswise clamping as well as clamping along the locking bolts. This depends on whether the locking heads clamp inside the receiver or clamp and lock behind the receiver. The clamping bolts are locked in the coupling element with displacement of the clamping blocks in the differently shaped coupling elements. Rotation of the locking bolts as well as the displacement of the clamping blocks can be performed easily without tools.

An aesthetically pleasant and preferred embodiment according to this invention is achieved with the cross pieces and the coupling elements having cross sections in the shape of an elongated hole, where the larger dimension is aligned horizontally. The dimension of the coupling elements in the longitudinal direction of the cross pieces to be connected is preferably approximately 25 mm.

In another preferred embodiment according to this invention, the coupling elements have two semicircular end pieces which can be connected in one piece with a connecting bar oriented vertically to the diameter. Such one piece can be covered on the opposite side with a lid, thus forming a cable channel. It is even possible to continue a cable channel in the similarly constructed cross piece across the coupling points.

According to another preferred embodiment, the pivot seating of the locking bolts is accomplished with bolt holes that are placed in the end pieces of the coupling elements. The support bolts are inserted into the bolt holes and secured against relative rotation and protrude from both front faces of the coupling element. The locking bolts are rotatably seated in the eccentric bolt holes of the support bolts.

In another preferred embodiment, the locking heads are positioned as separate parts, eccentrically on the ends of the locking bolts in a manner fixed against relative rotation. The locking heads, which in cross section are round, in the relaxed position are flush with the cross section of the support bolts, while in the clamping position extend by the amount of their eccentricity beyond one side of the support bolts. Thus, in the relaxed position it is possible to insert the locking bolts with their locking heads easily into the receivers of the cross pieces and to rotate them into the clamping position. The unambiguous position of the support bolts and thus of the locking bolts seated rotatably in them is assured since the support bolts have flattened places and are secured against relative rotation in correspondingly flattened receivers of the cross pieces and/or the bolt holes in the end pieces of the coupling elements.

The rotation of the locking bolts is accomplished since the end sections and the support bolts have slits which partially extend over their circumference and through which there is access to the blind bore receivers in the locking bolts. An L-shaped lever is inserted through the slit and is maintained captively, but rotatably, in the blind bore receiver of the locking bolt.

Additional clamping on the coupling element of the two cross pieces which are to be connected with each other is achieved since the locking heads are constructed as clamping bows on the front faces oriented towards the support bolts. The clamping bows grip a receiver of a cover plate of the cross piece from behind and pull the cross pieces which are to be connected with each other in the direction towards the coupling element.

If the front faces of the cross pieces have clamping bolts or if the latter can be fastened there, then the clamping bolts can be locked in the coupling element since the clamping blocks each form a part of the keyhole receivers, which are associated with each other and rotated by 180°, and which are adjustable against the action of compression springs on screws inserted into the end pieces, crosswise to the longitudinal direction of the cross pieces which are to be connected with each other. In the relaxed position, the clamping blocks partially open the keyhole receivers and close them again in the clamping position.

According to another preferred embodiment of this invention, the displacement of the clamping blocks into a clamping position takes place with a lever which is rotatably seated on the screw and has an operating stud. In the relaxed position, the operating stud is located in a recess of the clamping block and in the clamping position, is guided out of the recess and adjusts the clamping block on the screw while increasing the spring tension and completing the keyhole receivers. The lever is supported on the head of the screw.

Thus, the assigned lever position can be selected such that in the relaxed position the lever extends vertically with respect to the bar of the coupling element, and in the clamping position is pivoted on top of the bar of the coupling element.

Front faces of the cross pieces which remain free and have either receivers or clamping bolts are covered with cover elements, according to a further embodiment of this invention. In such embodiment, the receivers or the clamping bolts can also be used for fixing the cover elements.

This invention will be described in detail through the use of preferred embodiments shown in the drawings.

DESCRIPTION OF PREFERRED EMBODIMENTS

Figure 1:
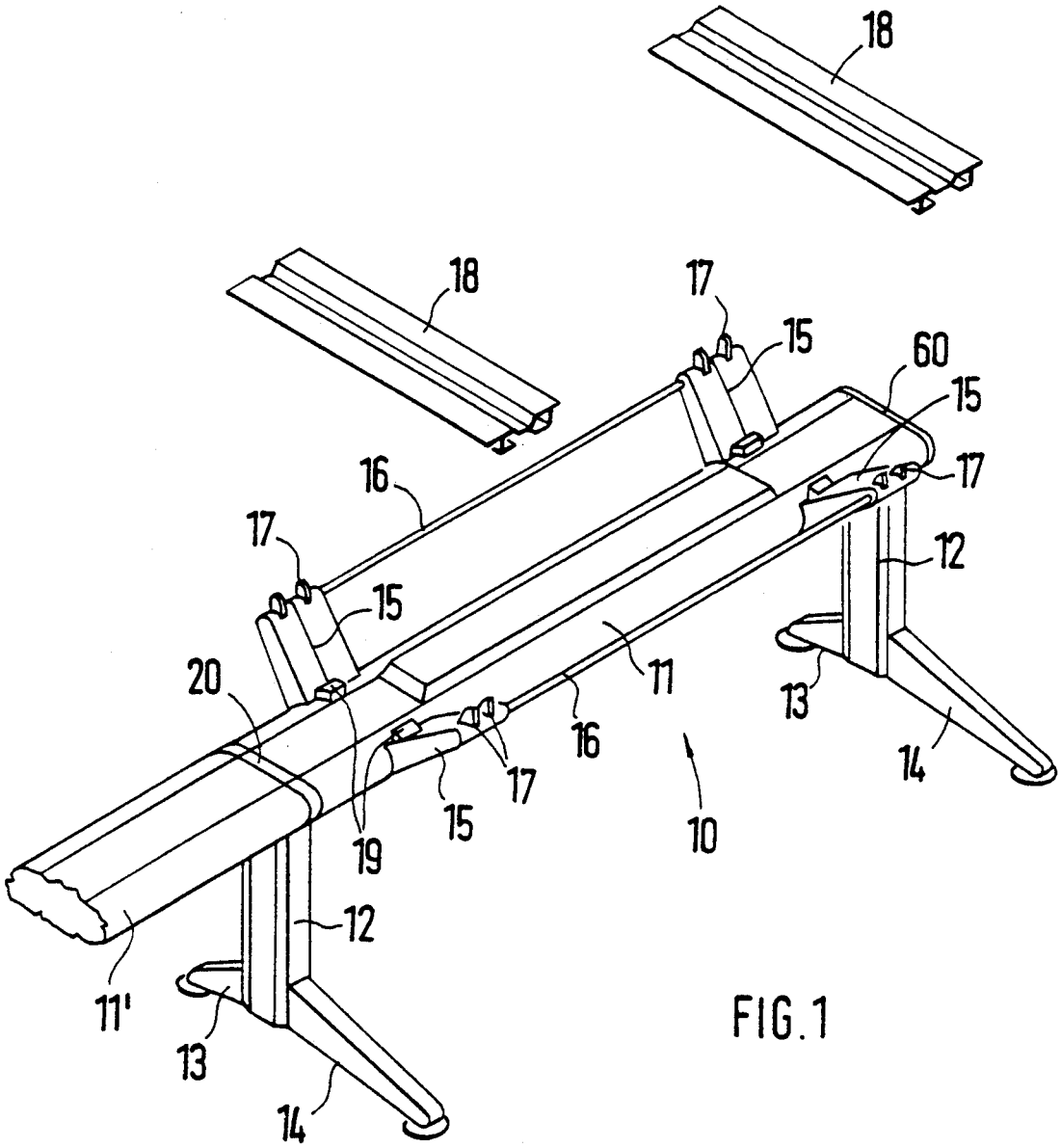
FIG. 1 is a perspective view of a table support with a cross piece, to which a further cross piece has been attached by a coupling element.
Figure 2:
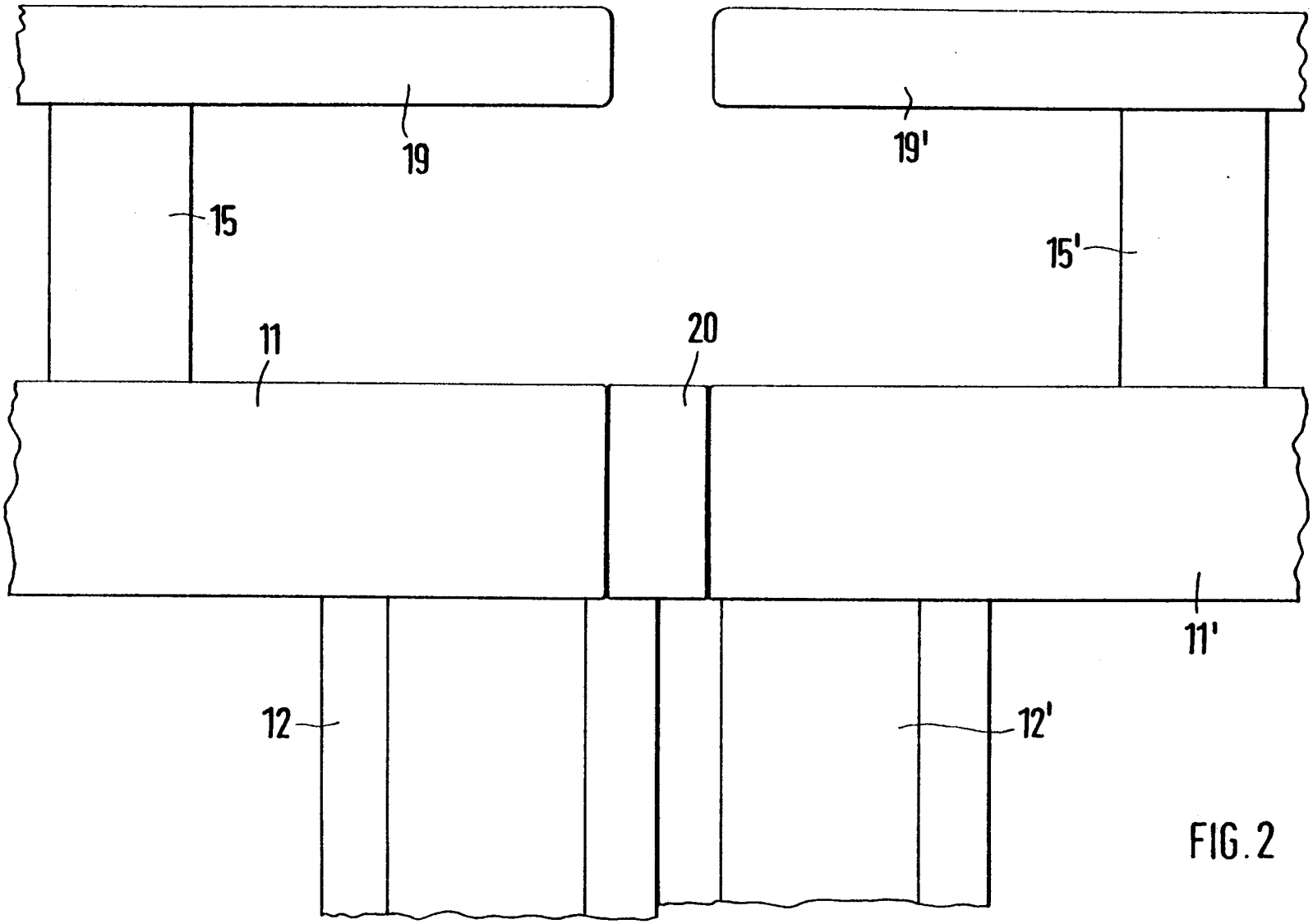
FIG. 2 is a schematic view of the coupling point between two office desks.

The basic structure of a table support 10 of an office desk is described in detail as shown in FIG. 1. The cross piece 11 connects the upper ends of the two table legs 12. The short foot elements 13 are positioned on the lower ends of the table legs 12, extending backward, and the long foot elements 14 extend towards the front. In the embodiment shown in FIG. 1, guides 19 for the hinged and pivotal application of the four support arms 15 are positioned on the longitudinal edges of the cross piece 11, which has an exterior shape in the form of an elongated hole. The height and inclination of the work surface, not shown, can be changed through the use of these support arms 15. The two guide rails 18 are positioned on the underside of the work surface, are oriented parallel to each other and extend from the front to the back. Sliders are adjustably guided in the guide rails 18 and the free ends of the support arms 15 are hinged on the sliders with the hinged shafts 17.

The support arms 15 are coupled in pairs with the coupling rods 18 and can be jointly pivoted. It is thus possible to raise or lower either only the front or only the back of the work surface. If all four support arms are evenly and jointly pivoted, the height of the work surface is varied, while a preset inclination is maintained.

A further cross piece 11' is connected through the coupling element 20 to the left front face, as shown in FIG. 1, of the cross piece 11. This cross piece 11' may be a part of another office desk or of a different piece of office furniture. The right front face, as shown in FIG. 1, of the cross piece 11 is closed off by the cover element 60.

The enlarged partial view in accordance with FIG. illustrates the connection of two office desks. The table legs 12 and 12' of the two office desks are directly adjacent and the work surfaces 19 and 19, are at a distance from each other, which is determined by the dimensions of the coupling element 20 in the longitudinal direction of the cross pieces 11 and 11'. The work surfaces 19 and 19' are connected with the cross pieces 11 and 11' with the pivotal support arms 15 and 15'. It is also possible to connect the table legs 12 and 12' with the cross pieces 11 and 11' in such a way that the same space is created between them as between the work surfaces 19 and 19'.

Figure 3:
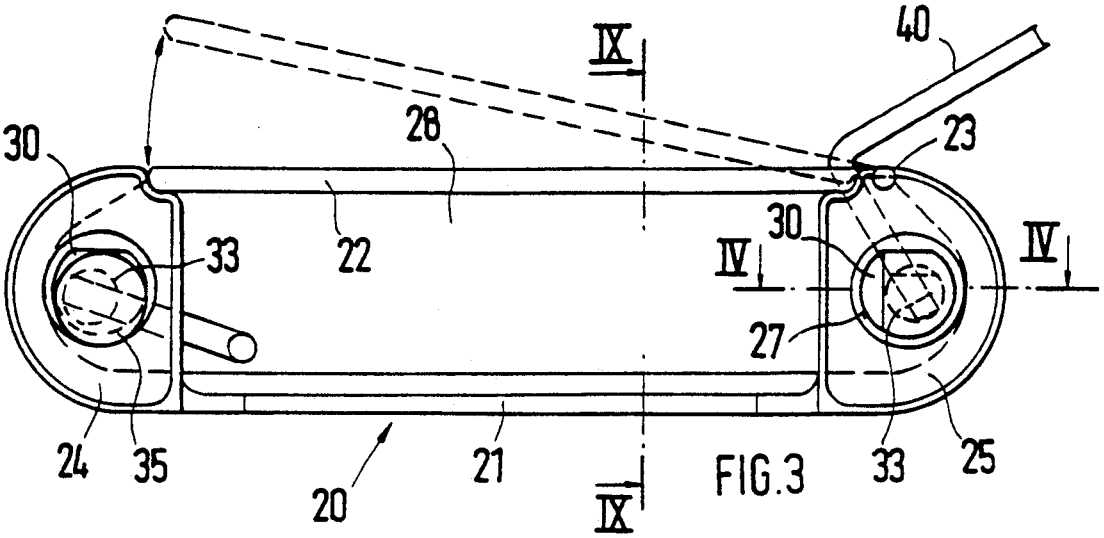
FIG. 3 is a side view of one preferred embodiment of a coupling element.

FIGS. 3 to 10 show one preferred embodiment of a coupling element 20. As shown in FIG. 3, the exterior cross section of the coupling element 20 is a horizontal elongated hole and corresponds to the exterior cross section of the cross pieces 11 and 11', so that the coupling element 20 provides a flush transition between the cross pieces 11 and 11' on all sides.

Figure 4:
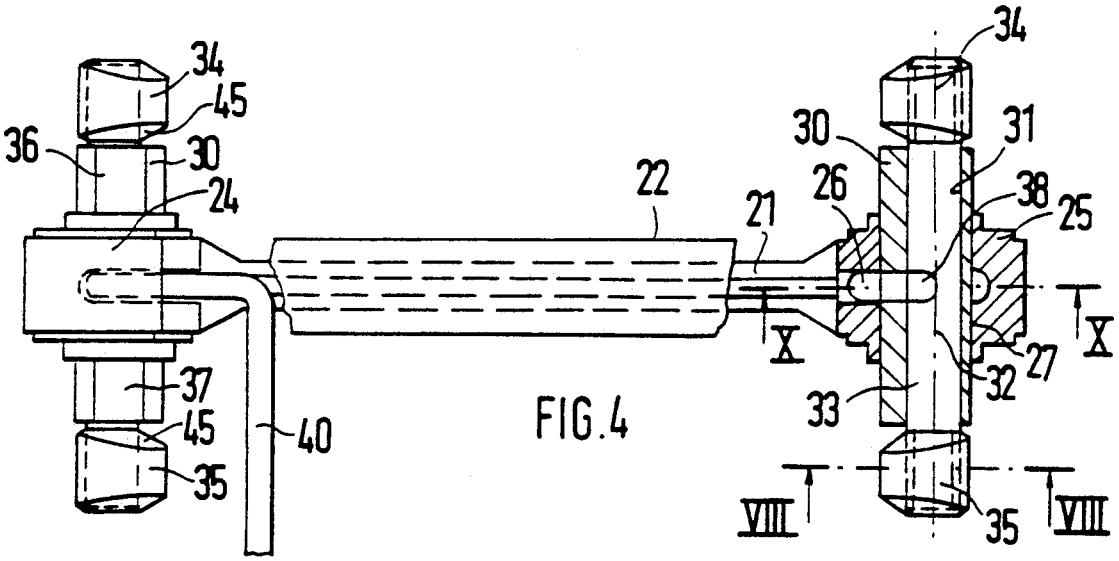
FIG. 4 is a top view of the coupling element with a support bolt and a locking bolt, as shown in FIG. 3, where an area taken along the line IV—IV of FIG. 3 is shown in partial cross section.
Figure 5:
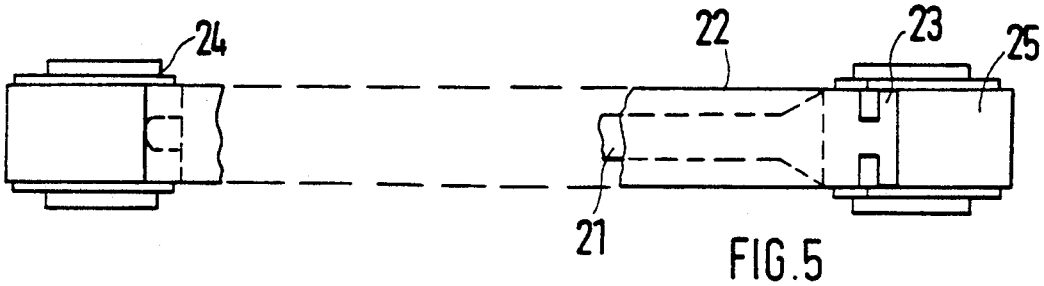
FIG. 5 is a top view of the base element of the coupling element with a lid.
Figure 6:
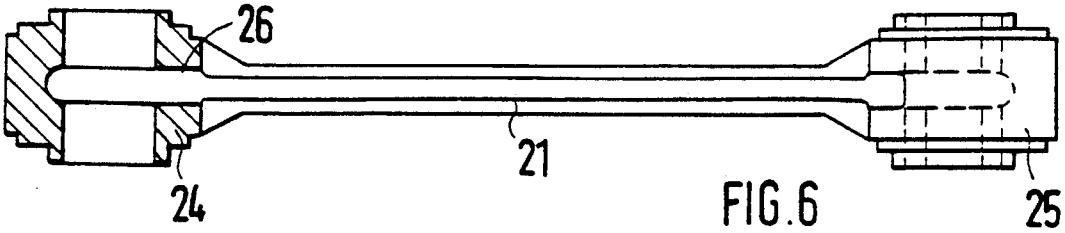
FIG. 6 is a top view of the base element.
Figure 8:
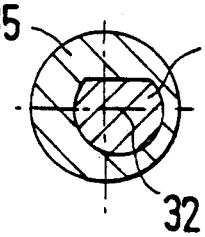
FIG. 8 is a cross-sectional view of the locking head of the locking bolt, taken along line VIII—VIII as shown in FIG. 4.
Figure 7:
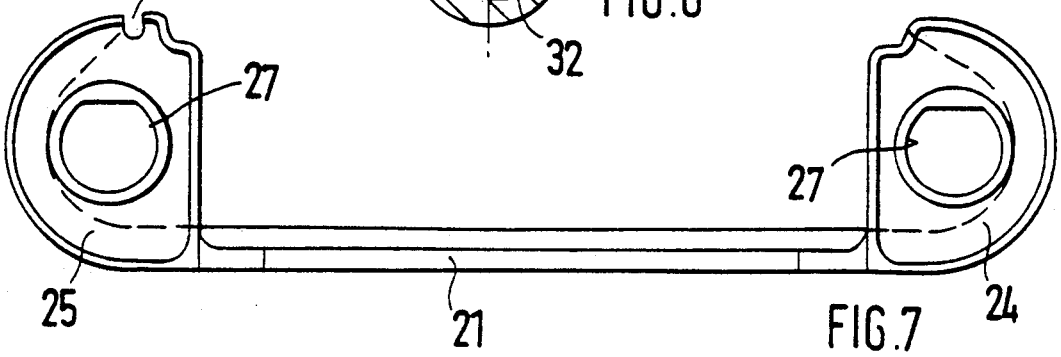
FIG. 7 is a side view of the base element.

The basic element of the coupling element 20 is the cast piece shown in FIGS. 6 and 7, comprising two semicircular end pieces 24 and 25 and the connecting bar 21. The end pieces 24 and 25 have a flattened bolt hole 27 for receiving support bolts 30 in a manner fixed against relative rotation, as shown in FIG. 4. As indicated by the reference numeral 23 on the end piece 25, a lid 22 can be pivotally seated there. As shown in FIG. 3, this lid 22 closes off the cable channel 28. A continuous cable channel, which is not interrupted at the coupling points, results if the structure of the cross pieces 11 and 11' is identical.

The support bolts 30 extend on both sides out of the coupling element 20 and have an eccentric bolt hole 31, in which a locking element 33 is rotatably seated. The eccentricities of the bolt holes 31 are each positioned towards the longitudinal edges, as shown in FIG. 4 by the sectional part with the rotational shaft 32. The ends of the locking bolts 33 have locking heads 34 and 35, which are fixed against relative rotation, as shown by the sectional view of FIG. 8.

Figure 9:
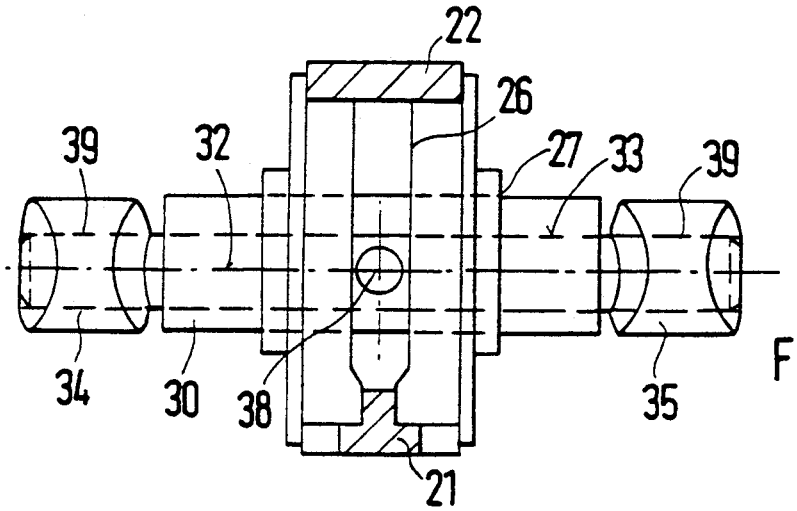
FIG. 9 is a cross-sectional view of the coupling element, taken along line IX—IX as shown in FIG. 3.
Figure 10:
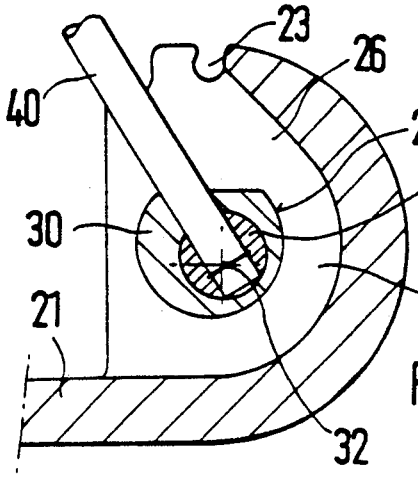
FIG. 10 a partial sectional view of the coupling element, taken along line X—X as shown in FIG. 4.

Slits 26 are cut in the center of the end pieces 24 and 25 from the direction of the cable channel 28, as illustrated in FIG. 9, which extend over a portion of the circumference of the support bolts 30 and are continued in it. L-shaped levers 40 are inserted through the slits 26 and are supported captively, but freely rotatable, as shown in FIG. 10. The locking bolts 33 can be turned with the levers 40, the slits 26 guiding the levers 40. In the relaxed position, which corresponds to the insertion position, the round locking heads 34 and 35 are flush with the exterior contour of the support bolts 30, as shown in FIG. 4, by the right support bolt 30 and the locking bolt 33. For this reason the support bolt 30, together with the locking bolt 33 and its locking heads 34 and 35, can be easily inserted into a receiver in the front face of the cross piece 11 or 11'.

If the lever 40 is rotated onto the bar 21 and let down, the locking bolt 33 takes up its clamping position in which the locking heads 34 and 35 extend on the inside beyond the support bolts 30, as can be seen in the left portion of FIG. 4.

If the receiver in the cover plate of the cross piece 11 and 11' is sufficiently deep, the locking heads 34 and 35 in the receiver can clamp the locking bolts 33 in such a way that the two cross pieces 11 and 11' are rigidly connected with each other through the coupling element 20.

If the receivers in the cover plates of the cross pieces 11 and 11' are positioned and adapted in such a way that the front faces of the locking heads 34 and 35 which are facing the support bolts 30 grip the receivers from behind as clamping bows, the cross pieces 11 and 11' are pulled towards each other and clamped and locked against the coupling element 20. Thus, the connection between the two cross pieces 11 and 11' is considerably improved, because the clamping bows of the locking heads 34 and 35 partially grip the receivers from behind which are flush with the bolt holes 27 in the end pieces 24 and 25. This can be seen in the left portion of FIG. 3, where the locking head 35 partially extends beyond the bolt hole 27.

For releasing the coupling, it is only necessary to bring the two locking bolts 33 of the coupling element 20 into the relaxed position. It is then possible to pull the locking bolts 33 with their locking heads 34 and 35 out of the receivers of the cross pieces 11 and 11'. The receivers in the cross pieces 11 and 11' can also be positioned and constructed such that they also receive the sections of the support bolts 30 which extend out of the base element.

Figure 11:
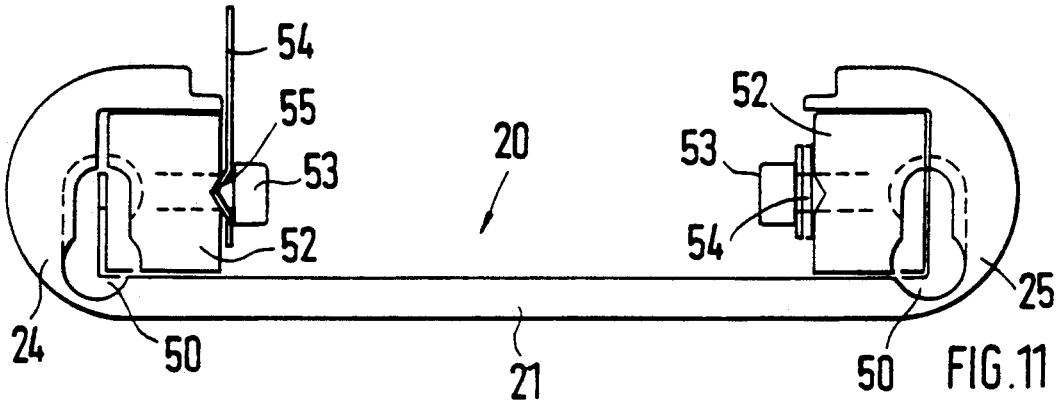
FIG. 11 is a side view of another preferred embodiment of a coupling element.
Figure 12:
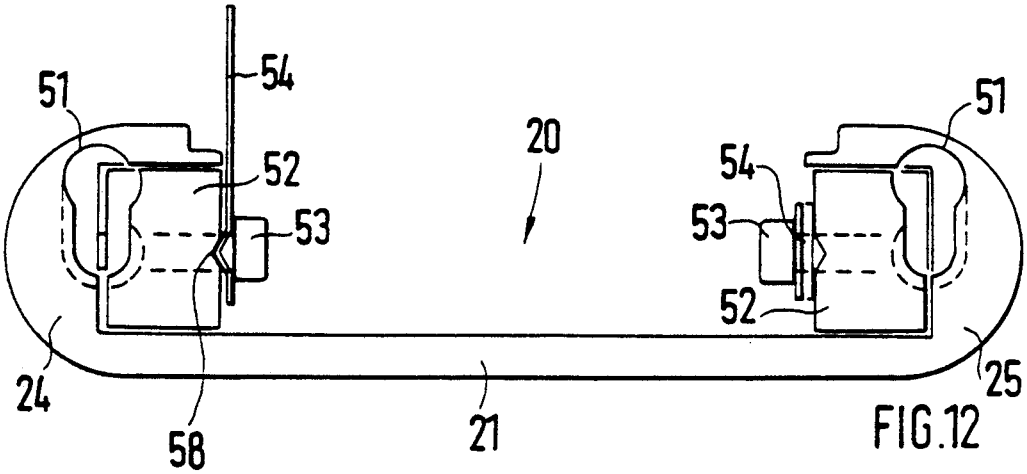
FIG. 12 is a side view of another preferred embodiment of a coupling element similar to that as shown in FIG. 11.

Another preferred embodiment of a coupling element 20 is described in detail as shown in FIGS. 11 to 15. In this embodiment, it is assumed that undercut clamping bolts 44 and 44' are positioned on the front faces of the cross pieces 11 and 11', instead of receivers. As shown by FIGS. 11 and 12, keyhole receivers 50 and 51 have been formed into the end pieces 24 and 25 of the coupling element 20. The keyhole receivers 50 and 51 are positioned vertically in pairs and are rotated by 180° on both sides. This eases the coupling of the cross piece 11' with the coupling element 20 latched to the cross piece 11. The side of the coupling element with the keyhole receivers 50, as shown in FIG. 11, is first latched to the clamping bolt 44 of the cross piece 11 and pushed upwards. Then the lifted cross piece 11' is latched to the keyhole receiver 51 of the side of the coupling element 20, in accordance with FIG. 12, and the cross piece 11' is downwardly displaced.

The pairs of keyhole receivers 50 and 51 are partially opened and can be closed by the associated clamping block 52. In this case the clamping bolts 44 and 44' are gripped from behind and a rigid connection between the cross pieces 11 and 11' and the coupling element 20 is thus provided.

Figure 13:
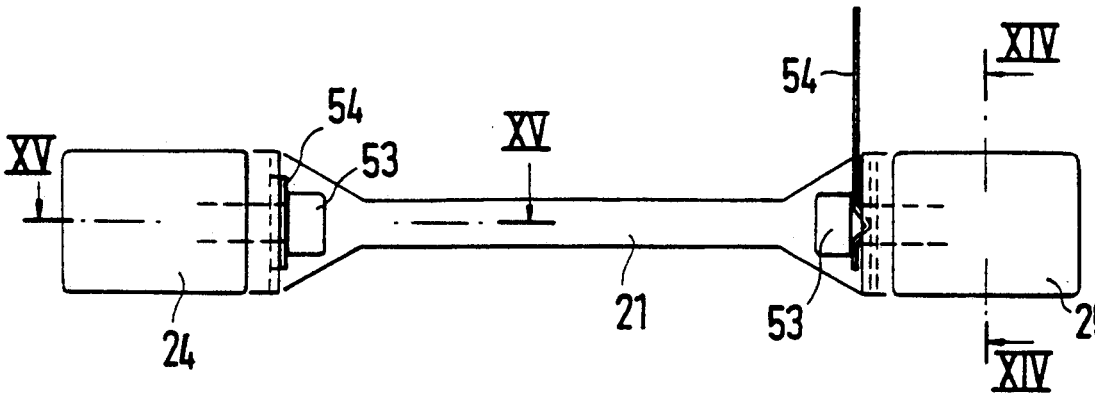
FIG. 13 is a top view of the coupling element as shown in FIG. 11.
Figure 14:
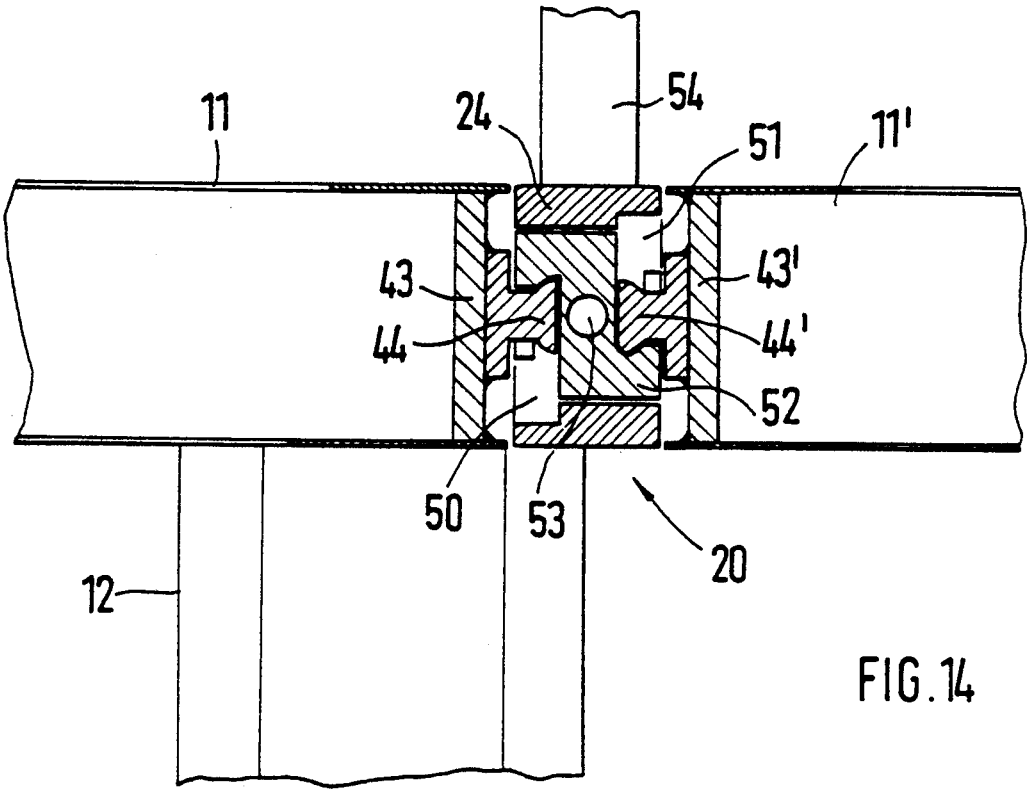
FIG. 14 is a sectional view of the coupling element, taken along the line XIV—XIV as shown in FIG. 13.
Figure 15:
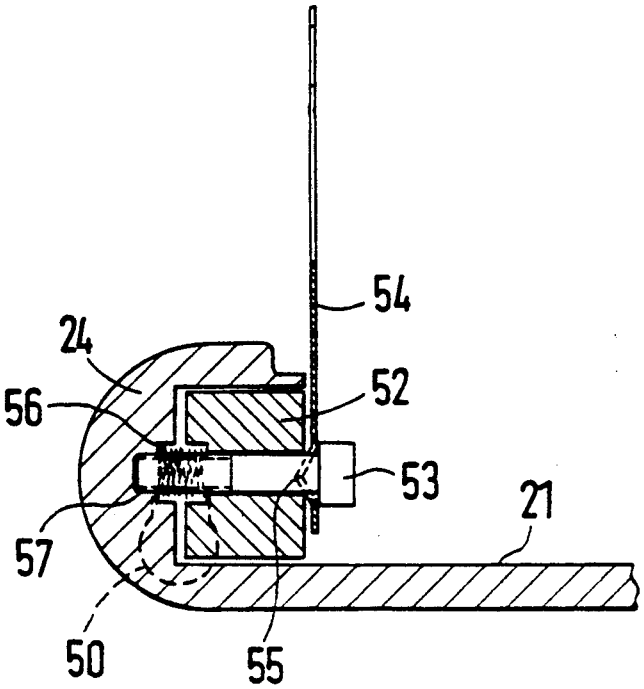
FIG. 15 is a sectional view of the coupling element, taken along the line XV—XV as shown in FIG. 13.

Clamping blocks 52 are adjusted with screws 53 which are rotated into the threaded receivers 57 of the end pieces 24 and 25, as shown in FIG. 15. In this embodiment, the screw 53 receives the compression spring 56, which is supported on the end piece, for example end piece 24, and the associated clamping block 52. The flat lever 54 is rotatably seated on the screw 53 in front of the head of the screw 53. If this lever 54 extends vertically, relative to the bar 21 of the coupling element 20, the clamping block 52 is in the relaxed position. The lever 54 is seated with its operating stud 55 in the recess 58 of the clamping block 52, which therefore is placed close to the head of the screw 53 by the compression spring 56, as shown in FIGS. 11 and 12, at the end piece 24. If the lever 54 is placed on the bar 21, the operating stud 55 is rotated out of the recess 58. During such movement, the clamping block 52 is displaced against the keyhole receivers 50 and 51 while the spring tension is increased. The keyhole receivers 50 and 51 are closed and the inserted clamping bolts 44 and 44' are gripped from behind, at least partially, so that the clamping bolts 44 and 44' can no longer be pulled out of the keyhole receivers 50 and 51, as shown in FIGS. 11 and 12, at the end piece 25. The sectional view in accordance with FIG. 13 shows how the clamping block 52 grips the clamping bolts 44 and 44' from behind and fixes them in the coupling element 20. The clamping bolts 44 and 44' are fastened on the cover plates 43 and 43', which are welded on the front faces of the cross pieces 11 and 11'.

Figure 16:
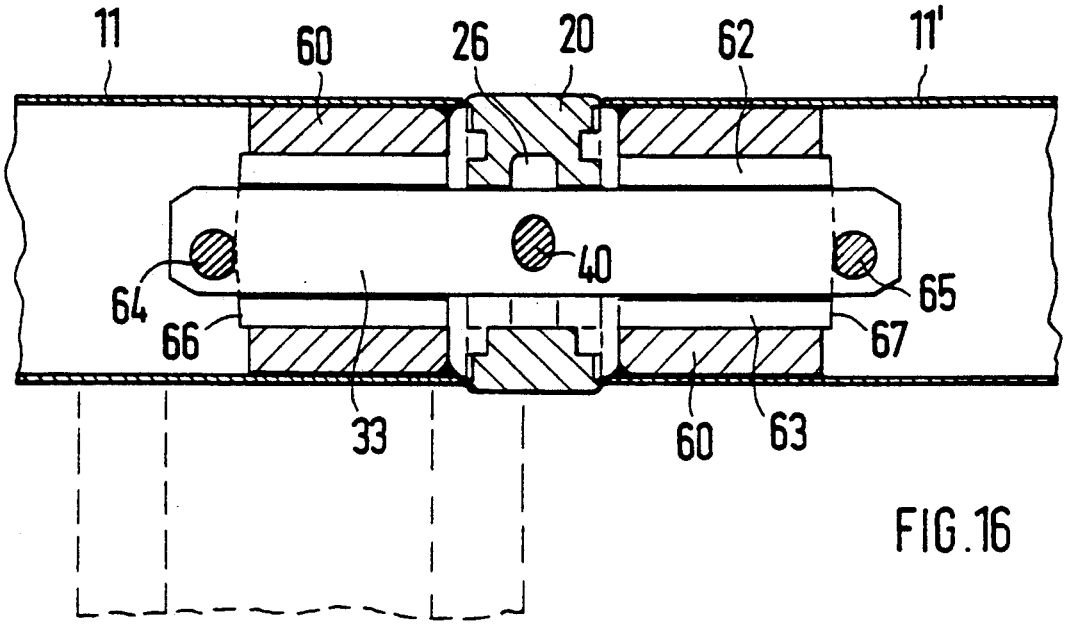
FIG. 16 is a vertical sectional view of the coupling point with a locking bolt according to another preferred embodiment of this invention.
Figure 17:
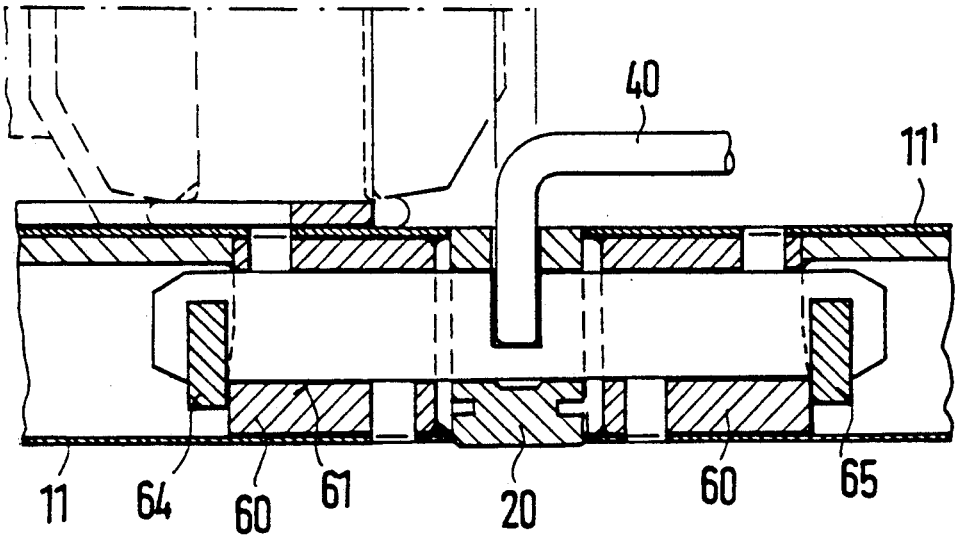
FIG. 17 is a horizontal sectional view of the coupling point as shown in FIG. 16.

As shown in FIGS. 16 and 17, the locking bolt 33 can be maintained in the coupling element 20 with the clamping lever 40. In such embodiment, the lever 40 is introduced by way of the slit 26 in the coupling element 20 into a bore of the latter and fixed therein. The adjoining cross pieces 11 and 11' are closed off at their front faces oriented towards each other with an insertion piece 60, which has a seating bore 61 for the locking bolt 33. So that the ends of the locking bolt 33 extending on both sides of the coupling element 20 together with the laterally extending clamping bolts 64 and 65 can be inserted into the seating bores 61 of the insertion pieces 60, each seating bore 61 has diametrically positioned longitudinal slits 62 and 63. If the locking bolt 33 is rotated with the lever 40, the clamping bolts 64 and 65 grip the front faces of the insertion pieces 60 from behind in the area of the seating bore 61. The area around the seating bore 61 can, in this embodiment, be designed as a clamping bow 66 and 67.

We claim:

1. In an office furniture piece combination having a plurality of pieces of office furniture each having a frame with a uniform cross piece (11, 11') with lateral legs (12, 12'), the cross pieces (11, 11') being connected with each other by non-free-standing coupling elements (20) having locking bolts (33) and receivers, a coupling element exterior cross sectional shape of each of the coupling elements (20) corresponding to a cross piece exterior cross sectional shape of each of the cross pieces (11, 11') and having a preset, identical dimension in a longitudinal direction of the cross pieces (11, 11'), the improvement comprising:

the receivers positioned within front portions of the cross pieces (11, 11');

a plurality of locking bolts (33) rotatably supported within the receivers of the cross pieces (11, 11');

the locking bolts (33) extending beyond both front faces of the coupling elements (20), and each said locking bolt (33) having two protruding clamping bolts (64, 65) each secured to opposite ends of said locking bolt (33); and during rotation of said locking bolts (33), said clamping bolts (64, 65) contacting and frictionally gripping said receivers and thus clamping the cross pieces (11, 11') with respect to the coupling element (20) and with respect to each other.

2. In an office furniture piece combination in accordance with claim 1, wherein the cross pieces (11, 11') and the coupling elements (20) have flattened cross sections in the shape of an ellipse with a major axis aligned horizontally, and a coupling element dimension of the coupling elements (20) in the longitudinal direction of the connected cross pieces (11, 11') is approximately 25 mm.

3. In an office furniture piece combination in accordance with claim 2, wherein the coupling elements (20) comprise two semicircular end pieces (24, 25) connected in one piece with a connecting bar (21), an end piece diameter of the semicircular end pieces (24, 25) is oriented vertically, and each semicircular end piece (24, 25) is covered on the opposite side with a lid (22), thereby forming a cable channel (28).

4. In an office furniture piece combination in accordance with claim 2, wherein end pieces (24, 25) of the coupling elements (20) have flattened bolt holes (27) into which correspondingly support bolts (30) are flattened, non-rotatably positioned, and the locking bolts (33) are rotatably seated in corresponding eccentric bolt holes (31) of the support bolts (30).

5. In an office furniture piece combination in accordance with claim 2, wherein the locking heads (34, 35) are eccentrically mounted and non-rotatably secured on end portions (39) of the locking bolts (33), the locking heads (34, 35) have a round cross section, in a relaxed position the locking heads (34, 35) are flush with a support bolt cross section of the support bolts (30), and in a clamping position eccentric edges of the locking heads (34, 35) extend beyond one side of the support bolts (30).

6. In an office furniture piece combination in accordance with claim 2, further comprising a plurality of support bolts (30) having flattened areas (36, 37), and the support bolts (30) non-rotatably secured within a plurality of corresponding flattened bolt holes (27) in a plurality of end pieces (24, 25) of the coupling elements (20).

7. In an office furniture piece combination in accordance with claim 2, wherein a plurality of end sections (24, 25) and a plurality of support bolts (30) have slits (26) which partially extend over their circumference, and access is provided through the slits (26) to a plurality of blind bore receivers (38) in the locking bolts (33).

8. In an office furniture piece combination in accordance with claim 7, further comprising an L-shaped lever (40) inserted through at least one of the slits (26) and captively and rotatably mounted in the blind bore receiver (38) of each of the locking bolts (33).

9. In an office furniture piece combination in accordance with claim 2, wherein the locking heads (34, 35) are formed as clamping bows on the front faces oriented towards a plurality of support bolts (30), and the contact and clamping bows frictionally grip a receiver of the cross piece (11, 11') and pull the cross pieces (11, 11') to be connected with each other in a direction towards the coupling element (20).

10. In an office furniture piece combination in accordance with claim 1, wherein the coupling elements (20) comprise two semicircular end pieces (24, 25) connected in one piece with a connecting bar (21), an end piece diameter of the semicircular end pieces (24, 25) is oriented vertically, and each semicircular end piece (24, 25) is covered on the opposite side with a lid (22), thereby forming a cable channel (28).

11. In an office furniture piece combination in accordance with claim 1, wherein end pieces (24, 25) of the coupling elements (20) have flattened bolt holes (27) into which correspondingly flattened support bolts (30) are non-rotatably positioned and the locking bolts (33) are rotatably seated in corresponding eccentric bolt holes (31) of the support bolts (30).

12. In an office furniture piece combination in accordance with claim 1, wherein the locking heads (34, 35) are eccentrically mounted and non-rotatably secured on end portions (39) of the locking bolts (33), the locking heads (34, 35) have a round cross section, in a relaxed position the locking heads (34, 35) are flush with a support bolt cross section of the support bolts (30), and in a clamping position eccentric edges of the locking heads (34, 35) extend beyond one side of the support bolts (30).

13. In an office furniture piece combination in accordance with claim 1, further comprising a plurality of support bolts (30) having flattened areas (36, 37), and the support bolts (30) non-rotatably secured within a plurality of corresponding flattened bolt holes (27) in a plurality of end pieces (24, 25) of the coupling elements (20).

14. In an office furniture piece combination in accordance with claim 1, wherein a plurality of end sections (24, 25) and a plurality of support bolts (30) have slits (26) which partially extend over their circumference, and access is provided through the slits (26) to a plurality of blind bore receivers (38) in the locking bolts (33).

15. In an office furniture piece combination in accordance with claim 14, further comprising an L-shaped lever (40) inserted through at least one of the slits (26) and captively and rotatably mounted in the blind bore receiver (38) of each of the locking bolts (33).

16. In an office furniture piece combination in accordance with claim 1, wherein the locking heads (34, 35) are formed as clamping bows on the front faces oriented towards a plurality of support bolts (30), and clamping bows contact and frictionally grip a receiver of the cross piece (11, 11') and pull the cross pieces (11, 11') to be connected with each other in a direction towards the coupling element (20).

17. In an office furniture piece combination in accordance with claim 1, wherein a plurality of cover elements (60) cover a plurality of free front faces of the cross pieces (11, 11') having the receivers.

18. In an office furniture piece combination in accordance with claim 1, wherein the cross pieces (11, 11') each have a U-shape with lateral legs formed as hollow bodies, a plurality of insertion elements (60) are inserted into front faces of the hollow bodies which each have one of the receivers (61) for a corresponding said locking bolt (33), and the receiver (61) has longitudinal slits (62, 63) for one of insertion of the locking heads (34, 35) extending from the ends of the locking bolt (33) and the clamping bolts (64, 65).

19. In an office furniture piece combination in accordance with claim 18, wherein the clamping bolts (64, 65) are inserted and fixed in crosswise oriented blind bores of the locking bolts (33).

20. In an office furniture piece combination having a plurality of pieces of office furniture each having a frame with a uniform cross piece (11, 11') with lateral legs (12, 12'), the cross pieces (11, 11') being connected with each other by non-free-standing coupling elements (20) having locking bolts (33) and receivers, a coupling element exterior cross sectional shape of each of the coupling elements (20) corresponding to a cross piece exterior cross sectional shape of each of the cross pieces (11, 11') and having a preset, identical dimension in a longitudinal direction of the cross pieces (11, 11'), the improvement comprising:

the receivers positioned within front portions of the cross pieces (11, 11');

a plurality of locking bolts (33) rotatably supported within the receivers of the cross pieces (11, 11');

the locking bolts (33) extending beyond both front faces of the coupling elements (20), and each said locking bolt (33) having two eccentric locking heads (34, 35) each secured to opposite ends of said locking bolt (33); and during rotation of said locking bolts (33), said clamping heads (34, 35) contacting and frictionally gripping said receivers and thus clamping the cross pieces (11, 11') with respect to the coupling element (20) and with respect to each other.

* * * * *